United States Patent [19]

Poitras et al.

[11] 4,068,582

[45] Jan. 17, 1978

[54] AUTOMATICALLY CONTROLLED NUMBERING MACHINE

[75] Inventors: André Poitras, Laval; Christian Tailleux, Longueuil, both of Canada

[73] Assignee: Equipment Precibec Inc., Montreal, Canada

[21] Appl. No.: 741,549

[22] Filed: Nov. 12, 1976

[51] Int. Cl.[2] ..... B41I 45/00

[52] U.S. Cl. ..... 101/76; 101/247

[58] Field of Search ..... 101/76, 77, 247, 70, 101/72, 218, 144, 145

[56] References Cited

U.S. PATENT DOCUMENTS

| | | | |
|---|---|---|---|
| 2,900,898 | 8/1959 | Buttner | 101/76 |
| 3,782,277 | 1/1974 | Neal | 101/76 |
| 3,985,073 | 10/1976 | Keller | 101/76 |

*Primary Examiner*—Ralph T. Rader

[57] ABSTRACT

This invention relates to numbering assembly incorporated into a conventional press of the offset type, which may selectively be rendered inoperative if numbering is not desired or printing is stopped, and which is automatically deactuated during the operation of the offset press if no printed material is discharged to avoid movement or change of numbers on the register in the absence of printed material on which a number is to be printed. The numbering assembly according to the invention, advantageously comprises an improved control assembly including a first electrical circuit comprising detection means responsive to the presence and absence of gripped material, a first normally open switch and a relay connected in series. The control assembly also includes a second electrical circuit which comprises a main switch, the above-mentioned relay and a first solenoid connected in series, which solenoid operates first mechanical means which in turn closes a third electrical circuit comprising a switch operated by the first mechanical means, the main switch and a second solenoid. The second solenoid operates second mechanical means which brings the numbering machine in operative position so that the number to be impressed be stepped each time a sheet of printed material is passing through the numbering machine.

4 Claims, 6 Drawing Figures

AUTOMATICALLY CONTROLLED NUMBERING MACHINE

The present invention relates to an automatically controlled numbering machine and more particularly to one incorporated in a conventional printing press of the offset type.

Numbering machines in which a printing register mounted on a rotatable carrier is stepped one unit after each printing operation so as to serially number a run of consecutive records, such as bills, checks, tickets or the like, fed at high speed past a printing position, are well known in the art of printing presses. Generally, the register stepping takes place under control of a stop fixedly mounted either on the printing machine frame or on the carrier. The stop acts during each one revolution cycle of the carrier to cam a pawl which effects the register stepping.

The main disadvantage of these prior art numbering machines when used in high speed cylinder presses lies in that the register is usually stepped one or several units upon stoppage of the printing press without any further printing operation being effected due to the residual inertia of the carrier.

The register then must be set back by hand before resuming the printing operation, which, of course, requires additional time, labor and expense.

Accordingly, numbering machines have been designed, which obviate this disadvantage.

For example, U.S. Pat. No. 2,900,898 in the name of Schnellpressenfabrik Aktiengesellschaft Heidelberg, discloses a numbering machine in which the stop for effecting the stepping of the register is movably arranged on the press frame and is coupled with the lever for starting and stopping the printing operations, so that it can be positively moved out of the path of movement of the machine when printing is stopped. This prevents the register to be stepped after the stopping of the printing operation, even when the machine continues to run idle without effective printing, and to resume its continuous advance upon continuation of the printing operation.

However, this does not prevent the register to be stepped if the press is in operation but the material to be printed has been exhausted or none is discharged to the delivery component.

U.S. Pat. No. 3,782,277 in the name of Maurice M. Neal, discloses an offset press numbering assembly which may be selectively rendered inoperative if numbering is not desired or printing is stopped, and which may be automatically deactuated when the press is in operation without discharging any printed material. For this purpose, the assembly includes sheet or paper detection means associated to the gripping means of the delivery machine and means for moving the register to a non-printing position and preventing the latter to be stepped in the absence of any printed material on which a number is to be printed.

However, the detection means responsive to the absence of any printed material in the offset press which is disclosed in this patent, necessitate very fine adjustment depending on the quality of the material supplied into the press and, as far as is understood, actually operate the deactivating means with a one rotation delay, that is only after having detected the absence of a first sheet of paper.

Moreover, the numbering assembly disclosed in this patent is not automatically reactuated when printed material is supplied again, and cannot be combined and used simultaneously together with other conventional machines used in printing presses for corrugating the printed material or accomplishing a further impression printing with a color different from the single color normally applied.

Accordingly, one object of the present invention is to provide a numbering assembly incorporated into a conventional press of the offset type, which may selectively be rendered inoperative if numbering is not desired or printing is stopped, and which is automatically deactuated during the operation of the offset press if no printed material is discharged to avoid movement or change of numbers on the register in the absence of printed material on which a number is to be printed.

Another object of this invention is to provide a numbering assembly incorporated into a conventional offset press which is automatically reactuated after having been deactuated during the operation of the press, when printed material is supplied again.

Still another object of this invention is to provide a numbering assembly incorporated into a conventional offset press, which can be combined and used together with other conventional machines such as corrugating or multicolor impression printing machines.

A further object of this invention is to provide a numbering assembly incorporated into a conventional offset press, which does not need rather complex mechanical and/or electronical adjustment.

The numbering assembly which is provided according to the present invention is characterized in that is comprises an improved control assembly incorporated in cooperative relationship into a conventional offset press of the type including a printing machine, a delivery machine cooperatively arranged relative to the printing machine for receiving the printed material discharged therefrom and delivers them to a point of deposit, said delivery machine including driving means and picking-up devices associated to said driving means for gripping the material discharged from the printing machine, and a numbering machine cooperatively arranged on a shaft relative to the delivery machine to serially number the printed material passing therethrough, said numbering machine including printing wheels having serial numbers thereon, a pawl for selectively stepped the printing wheels each time a number is to be impressed upon a sheet of printed material and a stop for actuating the pawl at each passage of a sheet of printed material.

According to the invention, the improved control assembly includes a first electrical circuit comprising detection means responsive to the presence and absence of gripped material, a first normally open switch and a relay connected in series. The detection means closes the first circuit when printed material is normally supplied and opens the same when printed material is missing. The first switch closes the first circuit for a short time at each rotation of the numbering machine shaft. The relay closes a second electric circuit for a predetermined period of time each time it receives an electric impulsion from the first switch. The improved control assembly also includes the above-mentioned second electrical circuit which comprises a main switch, the above-mentioned said relay and a first solenoid connected in series. The main switch permits to selectively deactuate the whole numbering assembly. The first solenoid operates first mechanical means which in turn closes a third electrical circuit. The improved control assembly further includes the above-mentioned third electrical circuit, which comprises a switch operated by the first mechanical means, the main switch and a second solenoid. The second solenoid operates second mechanical means which brings the stop of the numbering machine in operative position into the path of the pawl so that the number to be impressed be stepped each time a sheet of printed material is passing through the numbering machine.

When one or several sheets of printed material are missing, the detection means opens the first electrical circuit which in turn opens the second electrical circuit through the relay. The first solenoid being deactuated, the first mechanical means are released and the third electrical circuit is open. The second solenoid then being deactuated, the second mechanical means are released and move the stop out of the path of the stepping pawl. The duration of the whole deactuating operation is predetermined so that the numbering machine be deactuated only after the passage of the last sheet of paper through the numbering assembly.

According to a preferred embodiment, the numbering assembly further comprises an impression roller positioned beneath the numbering machine in cooperative relationship therewith, and a conventional inking device. The impression roller and inking device are both mechanically connected to and actuated by the first mechanical means.

The first mechanical means preferably comprises a first lever which is mounted on a central pivot and permanently provided with an oscillatory movement generated by a pullback spring and a cam mounted on the numbering machine shaft, blocking means connected to the first solenoid for holding the first lever in an operative position relative to the switch of the third electrical circuit when the second circuit is closed, and connecting means mounted on the ends of the first lever for transmitting the oscillatory movement of the latter to the impression roller and inking device.

The second mechanical means preferably comprises a second lever connected to and operated by the second solenoid on which second lever is directly mounted the stop, and a blocking arm for holding said second lever on which is mounted the stop, in operative position relative to the path of the pawl of the numbering machine when the first and second electrical circuit are closed. The blocking arm is positioned in cooperative relationship above the cam mounted on the shaft of the numbering machine so that it can be moved up and release the second lever at each rotation of the shaft.

A normally opened switch is advantageously connected in series in the third electrical circuit, which switch is operated at each rotation of the numbering machine shaft in synchronized relationship with the passage of the cam moving up the blocking arm, so that the third electrical circuit be only closed for holding in operative position the second lever during the short time where the blocking arm is disengaged, provided that the first and second circuit be closed.

For a better understanding of the invention, a specific embodiment thereof will now be described by way of example only, with reference to the accompanying drawing in which.

Figure 1:
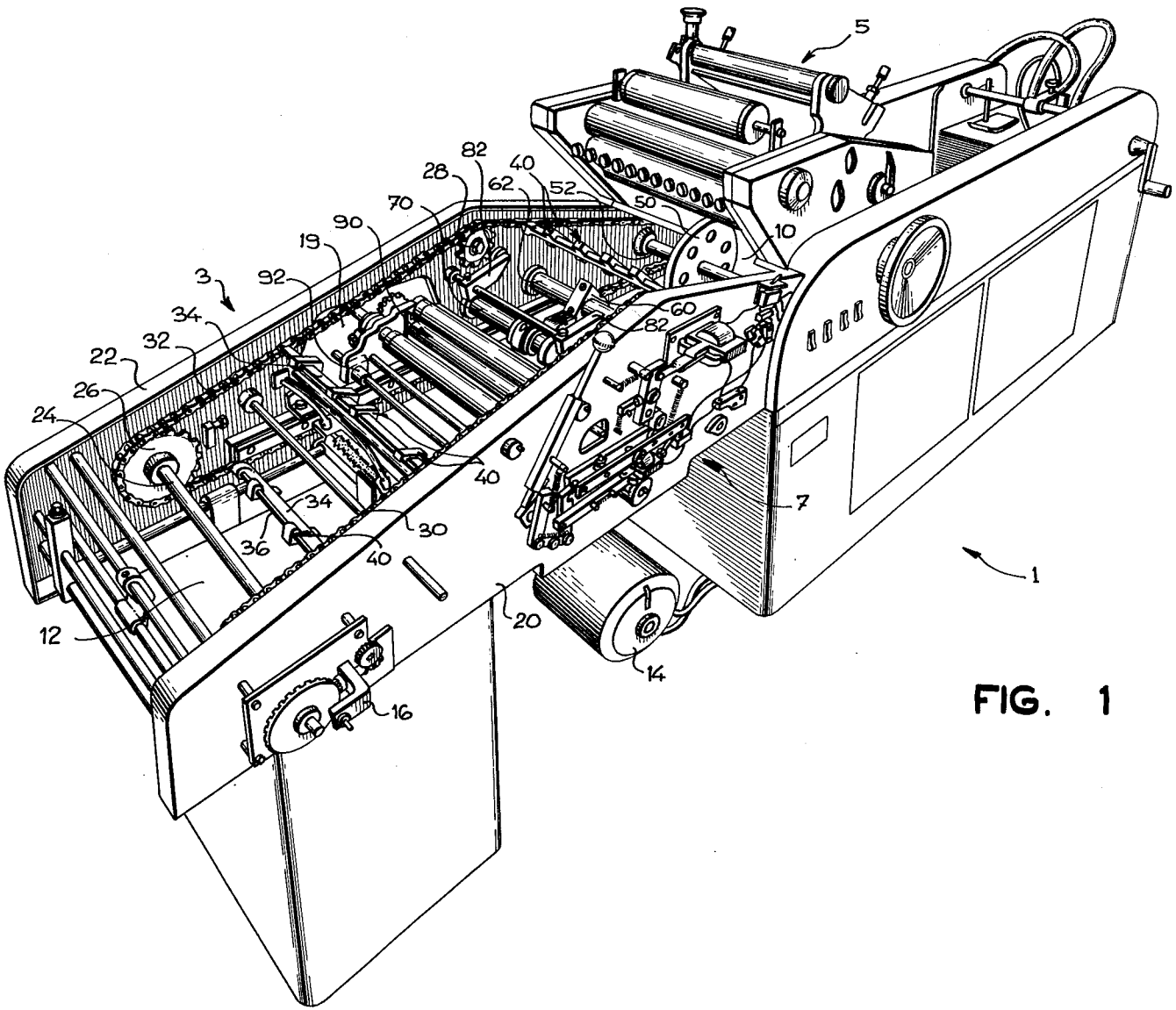
FIG. 1 is a perspective view of an offset press provided with the automatically controlled numbering machine according to the invention.
Figure 2:
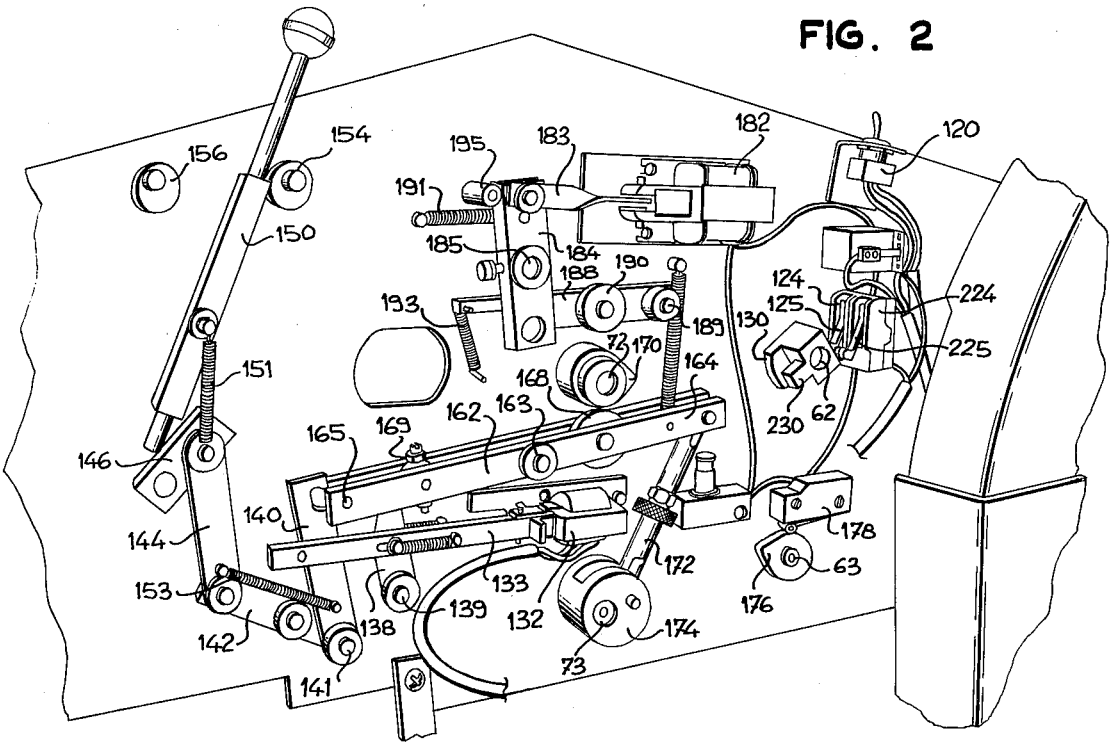
FIG. 2 is a perspective view of the control assembly of the numbering machine, in an inoperative position.

Referring to FIG. 1, the numbering machine according to the invention is part of a conventional offset press 1 including a printing machine 5 and a delivery machine 3. The offset press 1 will now be described further than necessary to an understanding of the invention, as no invention per se is claimed therefor.

The automatically controlled numbering machine according to the invention, which is hereafter generally designated by numeral 7, is cooperatively arranged relative to the delivery machine 3 which receives the printed material discharged from end 10 of the printing machine 5, and delivers them to a point of deposit 12.

For a better understanding of the invention, a brief description of the conventional construction and operation of the delivery machine 3 wiil be given.

The machine 3 includes two spaced walls 20 and 22 extending from end 10 of the printing machine 5 to deposit point 12. A first shaft not shown and a second shaft 24 are mounted between walls 20 and 22 near end 10 and point 12 respectively. These shafts both bear two sprocket wheels 26 adjacent the inner opposite walls 20 and 22, on which are mounted two suitable endless chains 30 and 32. Complementary sprocket wheels 28 are provided on both inner walls 20 and 22 to further guide the chains. Chains 30 and 32 are driven in a rotating movement by means of a conventional driving mechanism, not shown, operatively connected to the press assembly motor 14 in a well known manner. Connected to chains 30 and 32 in a predetermined spaced relationship, there are a plurality of material picking-up devices 34 of a conventional type which will be further described hereinafter. The pick-up devices 34 are spaced apart from each other in such a distance along the chains that a picking-up device 34 is positioned to receive and grip the printed material each time a sheet 8 thereof is discharged from the press at end 10. The sheets 8 of printed material are then carried by devices 34 to the point of deposit 12 where they are stacked and regularly aligned with respect to each other in a receiving tray, by a conventional jogger 16 operatively connected to the delivery machine 3 as will be hereinafter described.

Figure 5:
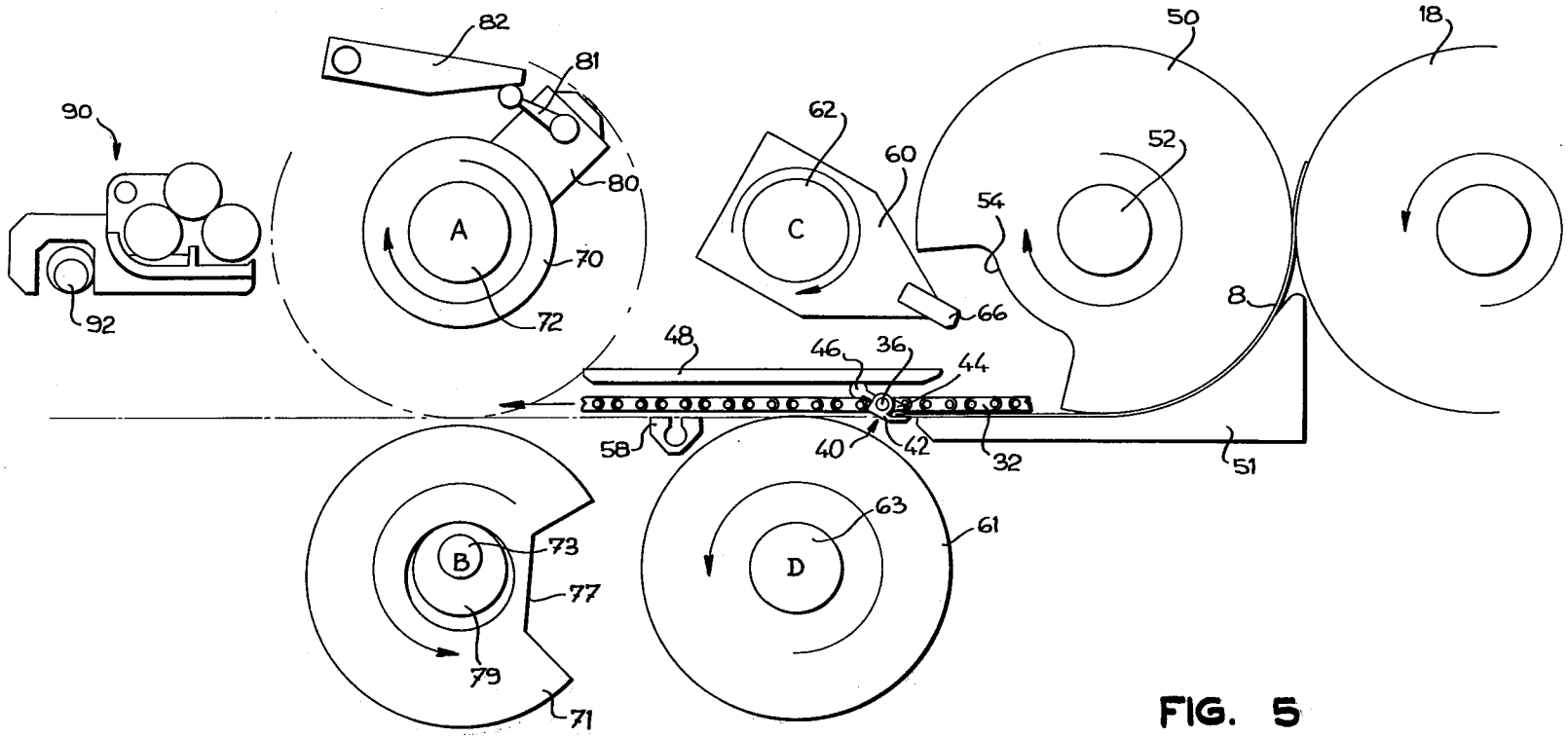
FIGS. 5 and 6 are schematic views showing the material picking-up end and printing assembly of the numbering machine according to the invention in two different working positions.
Figure 6:
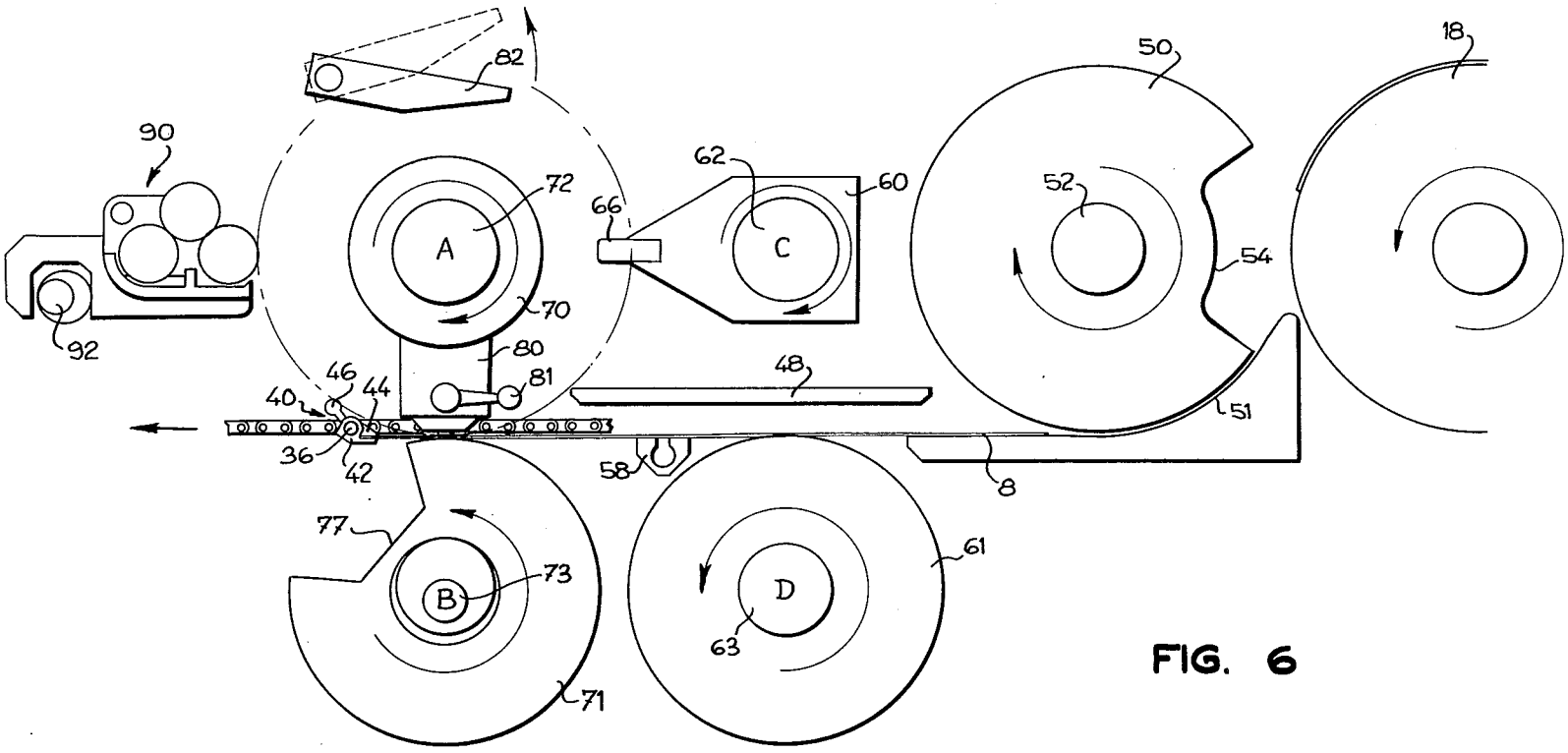

Each picking-up device 34 includes a shaft 36 extending between chains 30 and 32 and at least one gripping device 40 mounted on shaft 36 and operated by a well known cam arrangement as can be seen in FIGS. 5 and 6. The gripper 40 comprises two jaws 42 and 44 between which engages the leading edge portion of the sheet 8 of printed material. Jaws 42 and 44 are respectively affixed to and rotatably journalled on shaft 36. The outer end of jaw 44 overlies the corresponding end of jaw 42 and is closed upon the latter by means of a coil spring, not shown. The opening the gripper 40 is effected by means of a cam-follower 46 mounted on a level arm extending the movable jaw 44, which cooperates with a cam 48 disposed in its path in the zone where gripping is desired. Another cam is disposed in a similar manner in the zone near to point 12, where release of sheets 8 is desired.

Picking-up devices of the above-mentioned type are well known is this field of the art and will not be further described.

The sheets 8 of printed material which are discharged from the last roller 18 of the printing machine 5, are conveyed to the gripping zone where grippers 40 pick them up by means of a rotating wheel 50 adjacent to roller 18 cooperating with a shaped deflector 51 tangentially extending the surface of roller 18. Wheel 50 which is mounted on a rotating shaft 52 parallel to roller 18, is recessed on a portion 54 of its periphery to allow rotation of a pushing arm 60 mounted on a shaft 62 having an axis C parallel to that of shaft 52. The function of this rotating arm is to push forward each sheet 8 of printed material leaving the conveying zone so that the leading edge portion thereof fully engages between jaws 42 and 44 of the grippers 40 when the latter are in the opened position. For this purpose, a pad 66 is positioned at the end of arm 60 for tangentially pushing the sheet of printed material at each rotation of shaft 60, and a roller 61 mounted on a shaft 63 having an axis D parallel to axis C, is positioned beneath arm 60 and sheet 8 in cooperative relationship with pad 64.

The sheets 8 of printed material after having been picked-up by devices 34, are carried from the gripping zone to point 12 where they are released and stacked, and pass during this travel between the numbering machine 80 which is mounted on a drum 70 that in turn is mounted on a shaft 72 having an axis A, and a suitable impression roller 71 positioned beneath numbering machine 80 in cooperation relationship therewith. Impression roller 71 is mounted on a rotating shaft 73 having an axis B, and is actuated by an eccentric system 79 associated to shaft 73 in a known manner. This eccentric system presses upwardly roller 71 on the numbering machine 80 at a time synchronized with the time of passage therethrough of each sheet 8 of printed material, so as to obtain a better impression.

Impression roller 71 which extends across the whole path of sheets of printed material, is recessed on a portion 77 of its periphery to allow passage to shafts 36 and grippers 40, being provided that the not-recessed portion of the periphery of the roller has a length substantially equal to the length of the sheet 8 of printed material.

The numbering machine 80 which is used, is of a conventional type including a well known arrangement of printing wheels having serial numbers thereon, which are selectively advanced in a known manner by means of a pawl 81 each time a number is to be impressed upon a sheet to be printed. In this regard, it is pointed out that no invention is claimed in the numbering machine 80 per se. The printing wheels advance takes place under control of a stop 82 which can be selectively positioned in the path of pawl 81 so as to cam the latter at each rotation of drum 70.

As usual, a conventional removable inking device 90 including a plurality of rollers, is positioned in cooperative relationship with the numbering machine 80 so as to contact and the ink the same either automatically at each rotation of drum 70 or manually at selected moment, as will be described hereinafter.

According to the invention, the inking device 90 is shifted toward the numbering machine 80 by means of a cam 92 actuated in a synchronized relationship with the time of passage in front thereof of the numbering machine 80. Such a synchronized to and fro shifting movement of the inking device 90 advantageously allows any conventional corrugating or multicolor impression printing machines to be mounted on shaft 72 and therefore to be operated together with numbering machine 80, which has never been done as far as known. Inking device 90 can be easily removed from the press 1 when a differently colored ink is needed, through a hole 19 provided for that purpose in wall 22.

From the above, it will be understood and appreciated that a plurality of numbering machine 80 can be mounted on the single drum 70, if desired. In this case, the operation of all of the numbering machines will be the same.

By mere rotation of drum 70 which carrier numbering machine 80 and adjustment of camshaft 73 on which is mounted roller 71 it will be also understood that it is possible to selectively vary the location of the number to be printed on the printed material, the travelling movement of the picking-up devices 34 carrying sheets 8 being precisely timed to coincide with the printing phase wherein machine 80 is disposed downwardly and roller 71 is lifted upwardly by means of its shaft cam 73.

In order to ensure a still better impression of the number to be printed upon the sheet of printed material passing between numbering machine 80 and roller 71, sheet tensioning means 58 are provided before roller 71, which consists of an opened pipe extending across the path of the sheets and through which vacuum is made.

Figure 3:
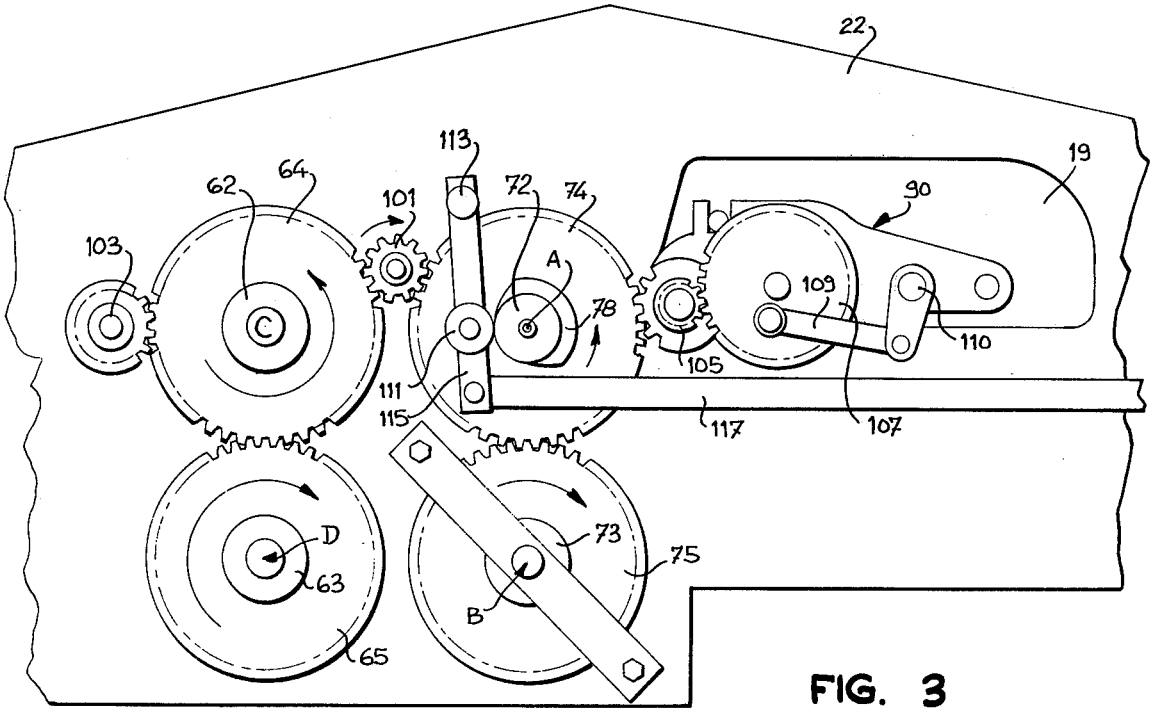
FIG. 3 is a plan view of the set of gearing wheels connecting the elements of the material pick-up end and printing assembly of the numbering machine.

Shaft 72 on which is mounted drum 70 and numbering machine 80, camshaft 73 on which is mounted impression roller 71, shaft 62 on which is mounted pushing arm 60 and shaft 63 on which is mounted roller 61, are all connected together and each rotated in the appropriate direction by means of a set of gear wheels operatively connected to the chain driving mechanism, as shown in FIG. 3, which is a plan view of a portion of the outer wall 22 of the delivery machine 3, taken from the rear of the machine.

As the view is taken from the rear of the machine, it will be seen that the respective position of axes A, B, C and D is inversed in comparison with FIGS. 5 and 6.

Shafts 62, 63, 72 and 73 extending across the delivery machine 3 are respectively fixed to four gear wheel 74, 64, 65 and 75 located outside wall 22. All of these wheels have the same diameter and pitch so as to rotate at a same speed synchronized with the travelling movement of the picking-up devices 34. Gear wheels 74 and 75 and gear wheels 65 and 64 are respectively in gear contact with each other, and gear wheels 64 and 74 are connected with each other by means of a transmission gear 101. The whole set of gear wheels is connected in a known manner to the chain driving means by means of a gear wheel 103. It can be seen that, in operation, gear wheels 64 and 74 driving shafts 62 and 72 respectively, both rotate in the same direction and gear wheels 65 and 75 driving shafts 63 and 73 respectively both rotate in the opposite direction, as indicated by arrows in FIGS. 3, 5 and 6.

Gear wheel 74 which is connected to driving gear wheel 103 through gear wheels 64 and 101, is in gear contact with another gear wheel 105 which in turn is in gear contact with a gear wheel 107. In operation, gear wheel 107 operates a cam 110 by means of a connecting rod and crank shaft 109, which, in turn, operates the inking rollers located insides the removable inking device 90.

Gear wheel 74 is also in contact by means of a cam 78 fixed on its shaft 72, with a roller 111 positioned on a lever arm 115 rotatably mounted on a pivot 113. Arm 115 is coupled with a rod 117, which, in turn, is coupled to the jogger mechanism. In operation, gear wheel 74 moves rod 117 back and fro in the longitudinal direction, which actuates the jogger 16 located beneath the point of deposit 12 of the delivery machine 3, as aforesaid.

The improved numbering machine assembly incorporated into a conventional offset printing press as above-described, advantageously further distinguishes over the prior art assemblies in that it also includes an improved control assembly 7 which may selectively render inoperative the numbering machine when numbering is not desired or printing is stopped, and which automatically deactuates the numbering machine 80 during the operation of the offset press 1 if no printed material is discharged and automatically reactuate the same when printed material is supplied again, so as to ensure a proper chronology of numbers on consecutive records without having to reset the numbering machine prior to each operation thereof.

According to the invention, the control assembly 7 is coupled to the stop 82 used to cam the actuating pawl 81 of the numbering machine 80.

If no printed material on which a number is to be printed is discharged from the ofset press 5 and conveyed by the delivery machine 3, control assembly 7 automatically moves stop 82 out of the path of pawl 81 and thus avoids the printing wheels of the numbering machine 80 to be advanced at each revolution of shaft 72. When printed material is discharged again from press 5, control assembly 7 automatically moves stop 82 in the path of pawl 81, which resumes stepping of the printing wheels of the numbering machine.

By means of control assembly 7, the stop 82 may also be selectively moved out of or in the path of pawl 81 to allow the press to be stopped without any further printing operation being effected due to the residual inertia of shaft 72 or to allow the press to keep on running when numbering is not required or desired, such as for example when a test run of a few sheets of printed material on which numerals are not desired, is requested to adjust the offset press 5.

Figure 4:
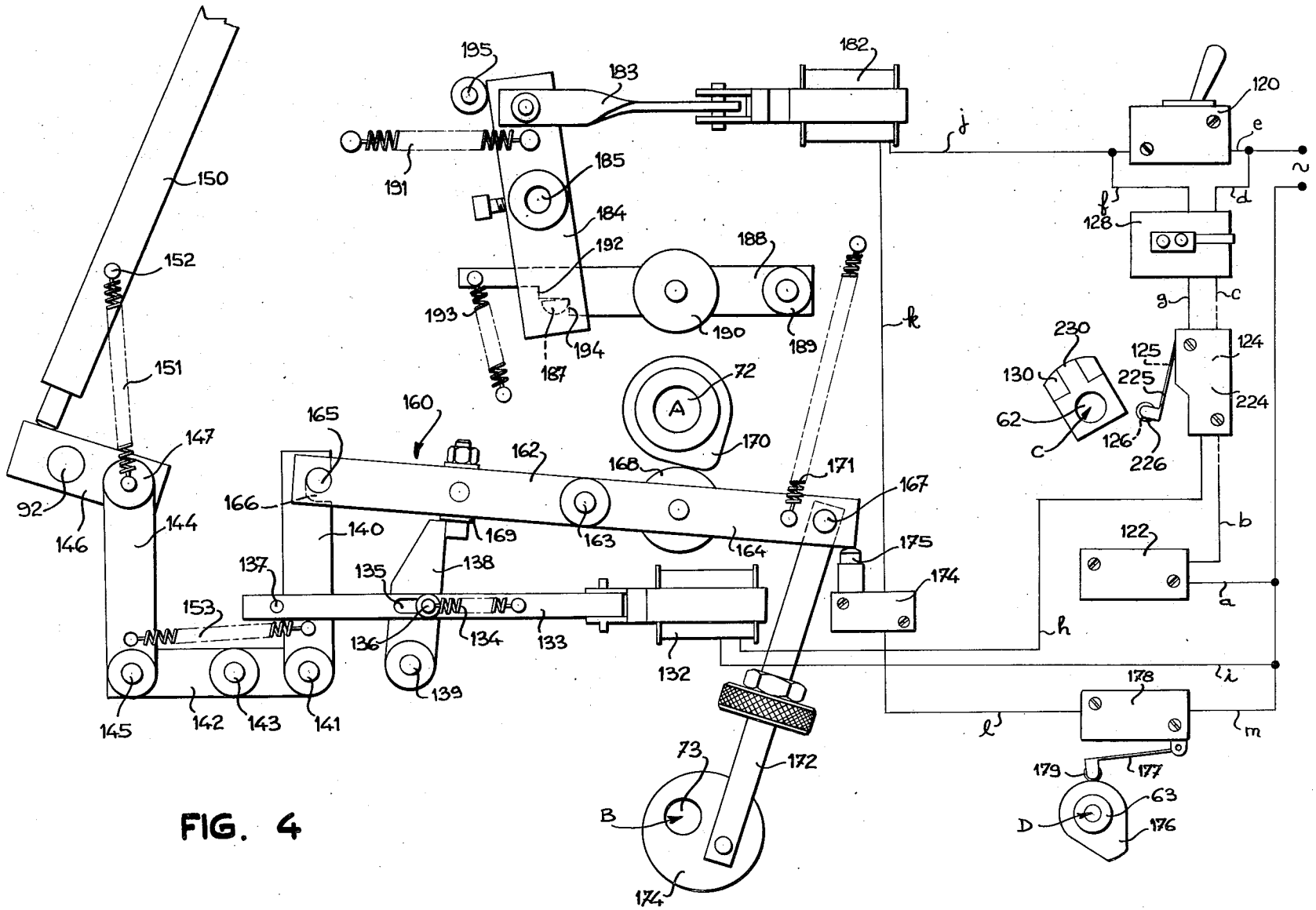
FIG. 4 is a plan view of the control assembly shown in FIG. 2, in an operative position.

Referring to FIG. 4, the control assembly 7 includes conventional detection means 122 responsive to the absence of printed material in the offset press 5. According to the disclosed embodiment, detection means 122 consist in a mechanically operated sensor disposed in the path of the sheets of printed material which switches on a first electrical circuit for a predetermined period of time each time a sheet 8 passes into contact therewith. The predetermined period of time during which the electric current is allowed to flow through the delay switch is selected so that electrical circuit be permanently switched on which printed material is normally supplied in the press and be switched off in the other case, such as for example when one or several sheets of printed material are missing.

It will be understood that these detection means 122 must be positioned in the printing machine 5 at such a distance from the numbering assembly that the control assembly 7 may deactuate the numbering machine 80 just after the printing of the last sheet 8 on which a number is to be printed.

It will be also understood that other conventional detection means such as a tie-delayed photoelectric cell having the same function may be used according to the invention in the place of the above-mentioned detection means.

The first electrical circuit which is permanently switched on by the detection means 122 when printed material is normally supplied, also comprises a switch 124 and a relay 128. These detection means 122, switch 124 and relay 128 are connected in series to a general electric source by means of a set of wires *a, b, c* and *d*.

Switch 124 which is of the normally open type comprising a resilient metallic lamella 125 provided at its free end with a roller 126, is actuated by a cam 130 fixed on shaft 62 on which is mounted the pushing arm 60. At each rotation of shaft 62, cam 130 moves lamella 125 toward in a switch-on position and connects wire *b* to wire *c*.

Thus, at each rotation of shaft 62, cam 130 operates relay 128 via switch 124, provided that detection means 122 are switched on by the passage of sheets of printed material.

Relay 128, every time that it receives an electric impulsion from switch 124, closes a second electric circuit for a predetermined period of time which substantially corresponds to the duration of the one rotation of shaft 62.

The second electric circuit which is switched on for a predetermined period of time every time the first electric circuit is completely closed, comprises in addition to relay 128 a main switch 120, another switch 224 and a solenoid 132. Main switch 120, relay 128, switch 224 and solenoid 132 are connected in series to the above-mentioned general electric source by means of a set of wires *e, f, g, h* and *i*.

Main switch 120 which is of the ON-OFF type, permits to manually open the second electric circuit and thus to selectively deactuate the numbering machine when numbering is not required or desired, while keeping the printing machine 5 on running.

Switch 224 which is of the normally closed type comprising a resilient metallic lamella 225 provided at its free end with a roller 226, is actuated by a cam 230 fixed on shaft 62 just beside cam 130. At each rotation of shaft 62, cam 230 moves lamella 225 toward in a switch off position and disconnects wire *g* with wire *h*.

The necessity of opening electric circuit at each rotation of shaft 62 will be fully explained hereinafter.

Solenoid 132, when electrically connected, pulls and holds in position a rod 134 which in turn pulls and holds in position simultaneously a blocking arm 138 mounted on a fixed pivot 139 and a latch 140 mounted on a pivot 141 positioned at the end of one arm of a lever 142. Latch 140 which is positioned near to the free end of rod 133, is pulled by means of a stop bolt 137 fixed on rod 133. Blocking arm 138 which is positioned near to the middle of rod 133, is pulled by means of a spring 134 fixed by one of its ends to rod 134 and by the other end to a pin 136 which is mounted on arm 138 and passes through rod 133 into a slot 135. This latter arrangement advantageously gives a slack to the blocking arm 138, which is necessary as will be seen hereinafter.

when they are pulled, latch 140 engages pin 165 fixed at the end of the left arm 162 of a lever 160 mounted on a fixed pivot 163, while blocking arm 138 engages below an abutment 169 mounted on arm 162 to block the latter downwardly.

Lever 160, which is provided with a roller 168 located near to the middle of its right arm 164, is connected by an adjustable link 172 fixed on the free end of its right arm 164 to a cam-actuating device 174 of a known type which actuates cam 73 of impression roller 71.

Lever 142 about one end of which is pivoted latch 140, is mounted on a fixed central pivot 143. The other end of lever 142 is connected by a pivot 145 to a link 144 which is oriented in a substantially parallel direction to latch 140. Link 144 in turn is connected by a pivot 147 to an arm 146 which operates cam 92 of the inking device 90.

It can easily be seen from the above, that, as soon as latch 140 engages pin 165 fixed at the end of the left arm 162 of lever 160, cam 92 which is used to shift in a to and fro movement the inking device 90, and cam 73 which is used to press upwardly the impression roller on the numbering machine 80, are both operatively associated to lever 160, whose main function is actually to provide impression roller 71 and inking device 90 both with an oscillatory movement in synchronized relationship with the time of passage of the numbering machine 80 in from thereof respectively.

For this purpose, lever 160 is urged against a cam 170 fixed on the shaft 72 on which is mounted the numbering machine 80, by means of a spring 171 fixed near to the end of the right arm 164 of lever 160. For a better working, cam 170 advntageously acts on the roller 168.

At each rotation of the numbering machine 80, the lever 160 is thus moved upwardly and downwardly by cam 170 in an oscillatory movement about its pivot 163, and moves up and down and to and fro in a synchronized relationship impression roller 71 and inking device 90 respectively.

When the solenoid 132 is electrically connected and the blocking arm 138 is engaged below the abutment 169, the lower end of the right arm 164 of the lever 160 is brought and held into contact with a puch button 175 associated to a normally open switch 174 connected in series to a third electrical circuit.

This third electrical circuit comprises in addition to switch 174, another switch 178, a solenoid 182 and the abovementioned main switch 120. Main switch 120, solenoid 182, switch 174 and switch 178 are also connected in series to the above-mentioned general electric source by means of a set of wire, *e, j, k, l* and *m*.

Main switch 120 is used to manually open this third electrical circuit and thus to selectively deactuate the numbering machine as it will be hereinafter described.

Switch 174, as aforesaid, is operated by lever 160 when the latter is actuated by solenoid 132. As solenoid 132 is operated when the second circuit is closed, it results that the third circuit can only be closed if the second circuit is closed, which in turn can only be closed if detection means 122 detects the pressure of any printed material normally supplied.

Switch 178, which is of the normally open type comprising a resilient metallic lamella 177 provided at its free end with a roller 179, is actuated by a cam 176 fixed on shaft 63 on which is mounted the roller 61 positioned in cooperative relationship with the pushing arm 60. At each rotation of shaft 63, cam 176 which is oriented exactly in the same direction as cam 170 which operates lever 160, moves lamella 177 upwardly in a switch-on position and connects wire *m with wire l*.

Solenoid 182, when electrically connected, pulls a rod 183 which in turn pulls the upper arm of a vertically oriented lever 184 mounted on a central shaft 185. Lever 184, which is permanently urged backwards by a spring 191 to bear against a stop 195, is provided at its lower end with a perpendicularly extending pin 187 of semi-circular cross-section which engages either an upper step 192 or a lower step 194 provided at one end of an arm 188.

Arm 188 which is mounted on a pivot 189 and urged downwardly by a spring 193 acting on the stepped end 192 is positioned in cooperative relationship just above the cam 170 fixed on shaft 72 on which is mounted the numbering machine 80.

At each rotation of the numbering machine 80, cam 170 moves upwardly and downwardly arm 188 in an oscillatory movement about its pivot 189. For a better working, cam 170 advantageously acts on a roller 190 positioned on arm 188 between the pivot 189 and the stepped end 192–194.

Stop 82, which controls the advance of the printing wheels of the numbering machine 80, is rigidly mounted on lever 184 and extends in a direction perpendicular to that of shaft 185. According to the invention, stop 82 is oriented about shaft 185 so as to be positioned in the path of the pawl 81 fixed on the numbering machine 80 when the lever 184 is pulled forwards by the solenoid 182 and held in forward position by the pin 187 which engages the upper step 192 of the arm 188, and to be out of the path of the pawl 81 when the level 184 is urged backwards by the spring 19 and the pin 187 engages the lower step 194 of the arm 188.

In operation, when printed material is normally supplied in the offset printing machine 5 and the main switch 120 is on ON, the first electrical circuit is permanently switched on by the detection means 122. At each rotation of the pushing arm 60 mounted on shaft 62, cam 130 then can operate relay 128 via switch 124, which in turn switches on the second electrical circuit for a predetermined period of time substantially corresponding to the duration of one rotation of shaft 62. It should be pointed out that the second electrical circuit is switched off at each rotation of shaft 62 by cam 230 acting on the normally closed switch 224 but is immediately after switched on again by cam 130 which is wider than cam 230 and therefore acts for a longer period of time upon switch 124 then cam 230 upon switch 224.

The second electrical circuit when closed operates solenoid 132 which pulls and holds in position rod 134, for the duration of almost one rotation of shaft 62.

Latch 140 thus engages pin 165 fixed at the end of the left arm 162 of lever 160 while blocking arm 138 engages below abutment 169.

During the small period of time where the second circuit is switched off and the electric current is cut in solenoid 132, lever 160 is urged by spring 171 against blocking arm 138 so that the latter is blocked, this consequently avoiding rod 133 to be released. In fact, release of rod 133 can only be obtained if the electric current is cut in the second circuit for at least a one rotation period of shaft 62.

When blocking arm 138 is engaged, the left arm 162 of lever 160 is blocked downwardly and the right arm 164 thereof bears on the push button 175 operating the normally open switch 174, which thus permanently closes the third electrical circuit.

At each rotation of shaft 63 on which is mounted the roller 61 positioned in cooperative relationship with the pushing arm 60, cam 176 operates solenoid 182 via switch 178, which pulls backwards rod 183 and brings stop 82 mounted on lever 184 in operative position in the path of pawl 81 of the numbering machine 80.

Stop 82 is permanently held in operative position even when cam 176 runs on out of switch 178, by means of the pin 187 which engages the upper step 192 urged downwardly by the spring 193.

As it has been previously said, cam 176 is oriented exactly in the same direction as cam 170 acting on arm 188. Thus, cam 176 operates the solenoid 182 and consequently holds in position the stop 82 in the same time that cam 170 moves upwardly arm 188 and allows pin 187 to disengage step 192. Thus, in operation, stop 82 which ensures the stepping of the printing wheels of the numbering machine 80 is always held in position in the path of pawl 81.

At each rotation of shaft 71 on which is mounted the numbering machine 80, cam 170 also moves downwardly the right arm 164 of lever 160 and provide the latter with an oscillatory movement. Lever 160 provides in turn the impression roller 71 and the inking device 90 both with an oscillatory movement in synchronized relationship with the time of passage of the numbering machine 80 in front thereof respectively.

Preferably, means are provides for selectively operating the inking device 90. These means comprise a manually operated lever 150 mounted on a pivot 152. Lever 150 acts on arm 146 which operates cam 92 and can jam the latter when desired by mere rotation from an adjustable stop 154 to another adjustable stop 156. Two pullback springs 151 and 153 are provided between pivot 152 and pivot 147 to permanently urge cam 92 up and between latch 140 and link 144 to permanently urge latch 140 back respectively.

When lever 150 is rotated in contact to stop 156 and 146 and consequently link 144, lever 142 and latch 140 are jammed. To allow lever 160 to continue its oscillatory movement even when latch 140 is jammed, the gap 166 in which engages pin 165 in latch 140 extends downwardly so that pin 165 can move upwardly and downwardly at each rotation of cam 170.

As soon as a sheet 8 of printed material is missing, detection means opens the first electrical circuit. Then, relay 128 being not actuated, the second electrical circuit is opened as soon as cam 230 acts on switch 224 and solenoid 132 is definitively deactuated. As long as cam 170 does not operate lever 160, the latter is held in a position against the blocking arm 138 by means of the spring 171. However, as soon as cam 170 moves downwardly the right end 164 of the lever 160 with a half rotation delay, latch 140 and blocking arm 138 disengage the lever 160 which in turn releases the push button 175. Latch 140 being disengaged, the back and fro movement of the inking device 90 stops. Simultaneously, the push button 175 being released, the third electrical circuit is opened and solenoid 182 is definitively deactuated. It results that as soon as cam 170 which still rotates, moves upwardly arm 188 with another half rotation delay, lever 184 is released and urges against stop 195 by spring 191 pin 187 thus engages the upper step of arm 188 which lever 184 which rotates about pivot 185 moves the stop 82 out of the path of the pawl 81 of the numbering machine 80.

As soon as a sheet 8 of printed material is missing, stop 82 which cams pawl 81 and consequently steps the numbering machine 80 at each rotation of its shaft 72, is thus moved upwardly in an inoperative position with a certain delay from the moment where the absence of a sheet 8 of printed material has been detected so that the last sheet of printed material passed in front of the detecting means 122 can however be printed when arriving in the numbering assembly.

From the above description, it will be understood that as soon as printed material is supplied again in the offset printing machine detection means 122 are again operated and the numbering operation is started again as it has been previously described.

Of course, the whole numbering operation can be selectively stopped when required or desired by means of the main switch 120 which directly cuts the second and third electrical circuits.

We claim:

1. In an offset press comprising a printing machine, a delivery machine cooperatively arranged relative to the printing machine for receiving the printed material discharged therefrom and delivering them to a point of deposit, and a numbering assembly comprising a numbering machine cooperatively arranged on a shaft relative to the delivery machine to serially number the printed material passing therethrough an impression roller positioned beneath the numbering machine in cooperative relationship therewith and an inking device, said delivery machine including driving means and picking-up devices associated to said driving means for gripping the material discharged from the printing machine, said numbering machine including printing wheels having serial numbers thereon, a pawl for selectively stepping the printing wheels each time a number is to be impressed upon a sheet of printed material and a stop for actuating said pawl at each passage of a sheet of printed material, the combination therewith of a control assembly comprising:

a first electrical circuit comprising detection means responsive to the presence and absence of gripped material, a first normally open switch and a relay connected in series, said detection means closing said first circuit when printed material is normally supplied and opening the same when printed material is missing, said first switch closing said first circuit for a short time at each rotation of the shaft of the numbering machine, said relay closing a second electric circuit for a predetermined period of time each time it receives an electric pulse, said second electrical circuit comprising a main switch, said relay and a first solenoid connected in series, said main switch selectively deactuating the numbering assembly, said first solenoid operating first mechanical means which in turn closes a third electrical circuit, said third electrical circuit comprising a switch operated by said first mechanical means, the main switch and a second solenoid, said second solenoid operating second mechanical means which brings the stop of the numbering machine in operative position into the path of the pawl so that the number to be impressed be stepped each time a sheet of printed material is passing through the numbering machine, said first mechanical means operated by the first solenoid of the second electrical circuit comprising a first lever which is mounted on a central pivot and permanently provided with an oscillatory movement generated by a pullback spring and a cam mounted on the shaft of the numbering machine, blocking means connected to the first solenoid for holding said first lever in an operative position relative to the switch of said third electrical circuit when the second circuit is closed, and connecting means mounted on the ends of the first lever for transmitting the oscillatory movement of the later to the impression roller and inking device.

2. An offset press a claimed in claim 1, wherein said second mechanical means comprises a second lever connected to and operated by the second solenoid, on which second lever is directly mounted the stop, and a blocking arm for holding said second lever on which is mounted the stop, in operative position relative to the path of the pawl of the numbering machine when the first and second electrical circuits are closed, said blocking arm being positioned in cooperative relationship above the cam mounted on the shaft of the numbering machine so that it can be moved up and release the second lever at each rotation of the shaft.

3. An offset press as claimed in claim 2, wherein a normally opened switch is connected in series in the third electrical circuit, which switch is operated at each rotation of the numbering machine shaft in synchronized relationship with the passage of the cam moving up the blocking arm, so that the third electrical circuit be only closed for holding in operative position the second lever during the short time where the blocking arm is disengaged, provided that the first and second electrical circuit be closed.

4. An offset press as claimed in claim 3, wherein the numbering assembly further comprises a corrugating machine mounted on the shaft of the numbering machine, for corrugating the printed material passing through said numbering machine.

* * * * *